US008321975B1

(12) United States Patent
Lindberg et al.

(10) Patent No.: US 8,321,975 B1
(45) Date of Patent: Dec. 4, 2012

(54) BED SHEET AND RETAINER SET

(76) Inventors: Timothy A. Lindberg, San Diego, CA (US); Alicia Lindberg, San Diego, CA (US)

( * ) Notice: Subject to any disclaimer, the term of this patent is extended or adjusted under 35 U.S.C. 154(b) by 0 days.

(21) Appl. No.: 13/230,697

(22) Filed: Sep. 12, 2011

(51) Int. Cl.
*A47C 21/02* (2006.01)

(52) U.S. Cl. ..... 5/498; 5/658; 5/659; 5/504.1

(58) Field of Classification Search ..... 5/482, 488, 5/498, 499, 658, 659, 663, 504.1
See application file for complete search history.

(56) References Cited

U.S. PATENT DOCUMENTS

| | | | | | |
|---|---|---|---|---|---|
| D138,963 | S | * | 10/1944 | Wandel | D6/607 |
| 4,400,836 | A | * | 8/1983 | Pelura | 5/498 |
| 4,539,723 | A | * | 9/1985 | Hillsberry | 5/504.1 |
| 4,712,262 | A | * | 12/1987 | Viggiano | 5/658 |
| 4,782,543 | A | * | 11/1988 | Hutton et al. | 5/658 |
| 4,794,660 | A | * | 1/1989 | Hawkrigg | 5/498 |
| 4,967,434 | A | * | 11/1990 | Hill | 5/658 |
| 5,033,139 | A | * | 7/1991 | Renfro | 5/658 |
| 5,255,403 | A | * | 10/1993 | Ortiz | 5/503.1 |
| 5,878,455 | A | * | 3/1999 | Patterson | 5/663 |
| 6,151,734 | A | * | 11/2000 | Lawrie | 5/640 |
| 6,295,670 | B1 | * | 10/2001 | Schieberl | 5/504.1 |
| 6,629,325 | B2 | * | 10/2003 | Heavrin | 5/662 |
| 6,682,037 | B1 | * | 1/2004 | Ouellette | 248/345.1 |
| 2002/0138902 | A1 | * | 10/2002 | Bennett | 5/504.1 |
| 2008/0222807 | A1 | * | 9/2008 | Hanes | 5/498 |

* cited by examiner

*Primary Examiner* — William Kelleher
(74) *Attorney, Agent, or Firm* — Mandour & Associates, APC

(57) ABSTRACT

The present disclosure relates to a bed sheet and to an apparatus for securing a bed sheet or fitted sheet to a mattress. The bed sheet and apparatus, namely a bed sheet retainer set, preferably comprise a fitted bed sheet having four corners and a flat sheet. Both the fitted sheet and flat sheet are placed on a mattress above a box spring. The bed sheet retainer set preferably comprises a fitted sheet restrictor having cylinder with a slot and a base for placement between the mattress and box spring, four corner grips for use on the fitted sheet and two flat sheet grips for use with the flat sheet. The corner grips and flat sheet grips are preferably made of machine-washable foam with a rougher surface. The corner grips preferably each have a semi-circular base and a rounded corner wall. The flat sheet grips preferably have an hour-glass shape and rounded edges.

3 Claims, 6 Drawing Sheets

BED SHEET AND RETAINER SET

FIELD

The present disclosure relates to a bed sheet and to an apparatus for securing a bed sheet or fitted sheet to a mattress.

BACKGROUND

Bed sheets are commercially available in standard sizes to accommodate a variety of dimensions for mattresses. Conventional bed sheets are fitted to a specific mattress dimensions and typically contain elastic corners that wrap around a corresponding edge and underside of a mattress. The elastic corners of a conventional fitted bed sheet are an imperfect solution for securing a sheet to a mattress. Elastic corners can become worn from regular washing or stretching.

In addition to fitted sheets, conventional bed sheets do not provide a method for securing other sheets the mattress. While conventional bed sheets enjoy widespread use, such bed sheets tend to shift or lose connection to a mattresses' edge. Thus, an apparatus that further secures a fitted bed sheet and/or flat sheet to a mattress while being easily removable and washable is desired.

SUMMARY OF THE INVENTION

The present disclosure relates to a bed sheet and to an apparatus for securing a bed sheet or fitted sheet to a mattress. The bed sheet and apparatus, namely a bed sheet retainer set, preferably comprise a fitted bed sheet having four corners and a flat sheet. Both the fitted sheet and flat sheet are placed on a mattress above a box spring. The bed sheet retainer set preferably comprises a fitted sheet restrictor having cylinder with a slot and a base for placement between the mattress and box spring, four corner grips for use on the fitted sheet and two flat sheet grips for use with the flat sheet. The corner grips and flat sheet grips are preferably made of machine-washable foam with a rougher surface. The corner grips preferably each have a semi-circular base and a rounded corner wall. The flat sheet grips preferably have an hour-glass shape and rounded edges.

BRIEF DESCRIPTION OF THE DRAWINGS

The present invention described herein will become apparent from the following detailed description considered in connection with the accompanying drawings, which disclose several embodiments of the invention. It should be understood, however, that the drawings are designed for the purpose of illustration and not as limits of the invention.

DETAILED DESCRIPTION OF PREFERRED EMBODIMENTS

Figure 1:
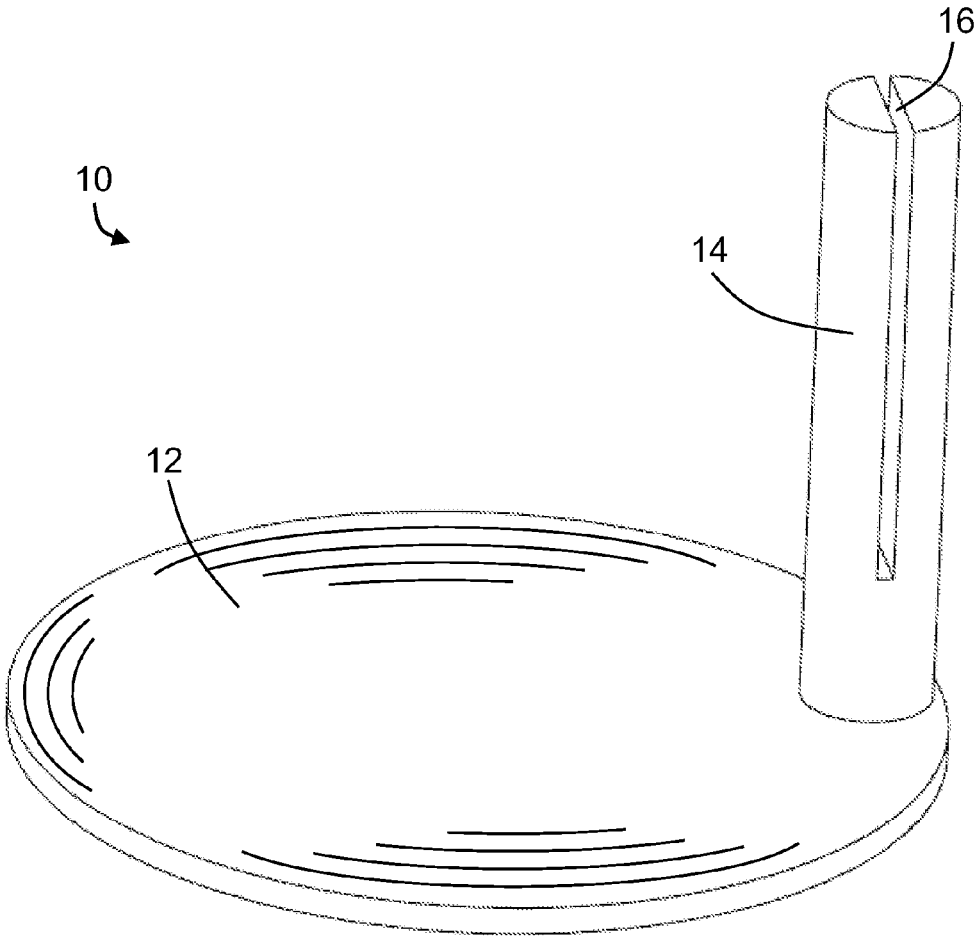
FIG. 1 is a perspective view of a preferred embodiment of a bed sheet restrictor.

Various embodiments are now described with reference to the drawings, wherein like reference numerals are used to refer to like elements throughout. In the following description, for purposes of explanation, numerous specific details are set forth in order to provide a thorough understanding of one or more embodiments. It may be evident, however, that such embodiment(s) may be practiced without these specific details.

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

Figure 4:
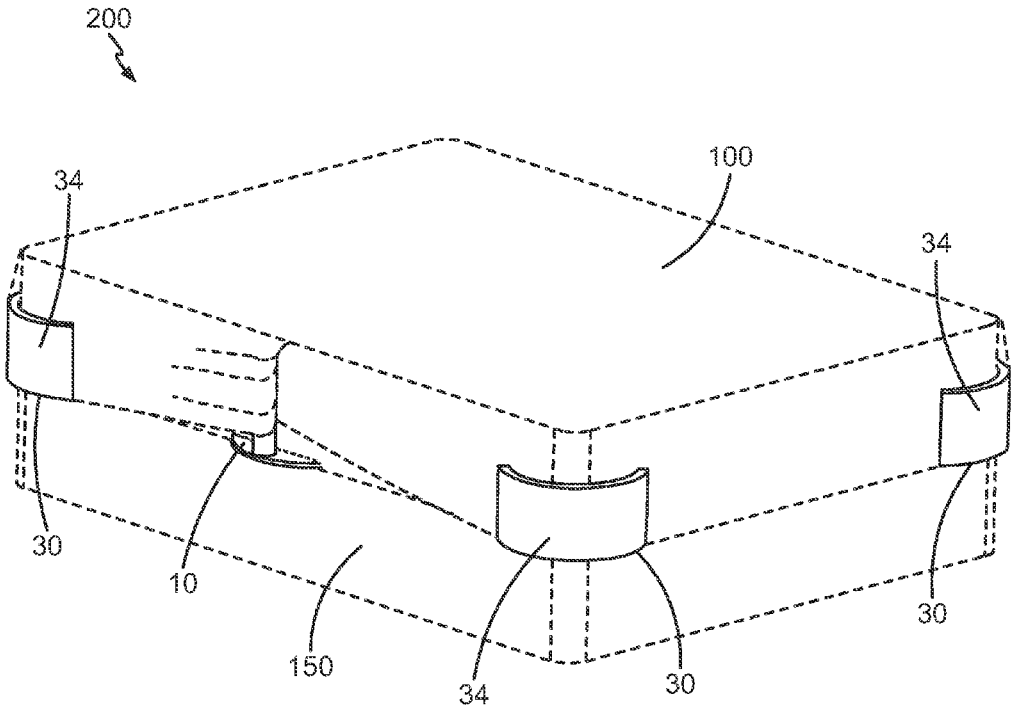
FIG. 4 is a perspective view of a preferred embodiment of the invention installed on a mattress and box spring.

Referring now to FIG. 1, a preferred embodiment of a sheet restrictor 10 is shown. The sheet restrictor 10 preferably comprises a base 12 with a cylinder 14 mounted perpendicular to the base 12. The cylinder 14 preferably has a slot 16. The base 12 is preferably rounded, circular or oval shape. The base 12 may have a textured surface suitable to prevent slipping. The slot 16 of the cylinder 14 is preferably sufficiently wide for the insertion of a sheet or blanket (not shown.) As shown in FIG. 4, the sheet restrictor 10 is preferably attached to the fitted sheet 200. The fitted sheet 200 is preferably inserted into the slot 16 on the restrictor 10. The restrictor 10 is then rotated so the fitted sheet 200 is twisted around the cylinder 14 of the restrictor 10. The base 12 of the restrictor 10 is then inserted between the mattress 100 and box spring 150 to hold the restrictor 10 in place. This use of the restrictor 10 tightens the fitted sheet 200 to the mattress 100. The sheet restrictor 10 is preferably made of a plastic that can be sterilized for repeated uses. The sheet restrictor 10 is preferably made of rigid high-density polyethylene plastic. However, other rigid or hard plastics can be used.

Figure 2:
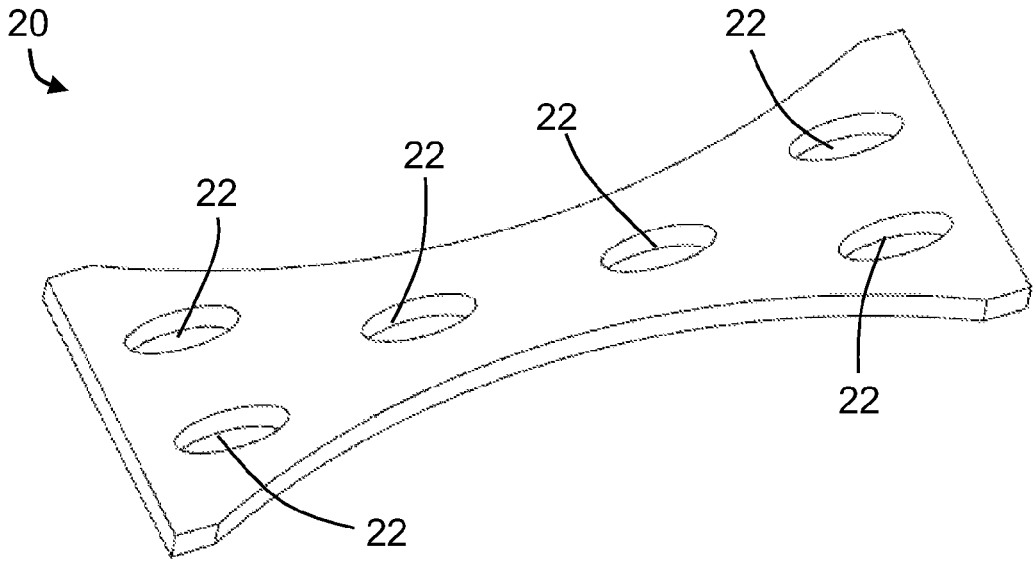
FIG. 2 is a perspective view of a preferred embodiment of a sheet grip.
Figure 5:
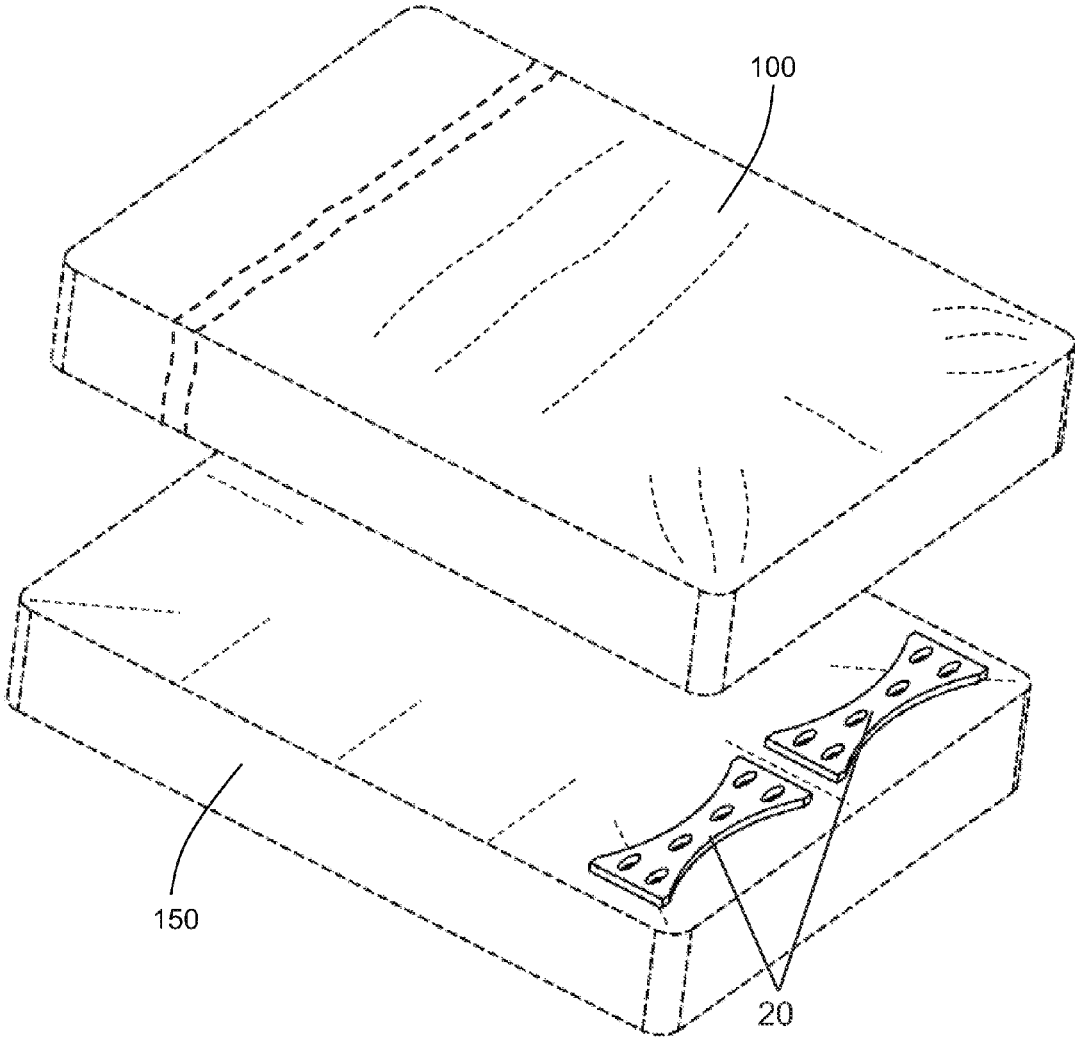
FIG. 5 is a perspective view of a preferred embodiment of two sheet grips installed between a mattress with a flat sheet and a box spring; and, FIG. 6 is a side partial cross-sectional view of a preferred embodiment of a sheet grip installed between a mattress with a flat sheet and a box spring.
Figure 6:
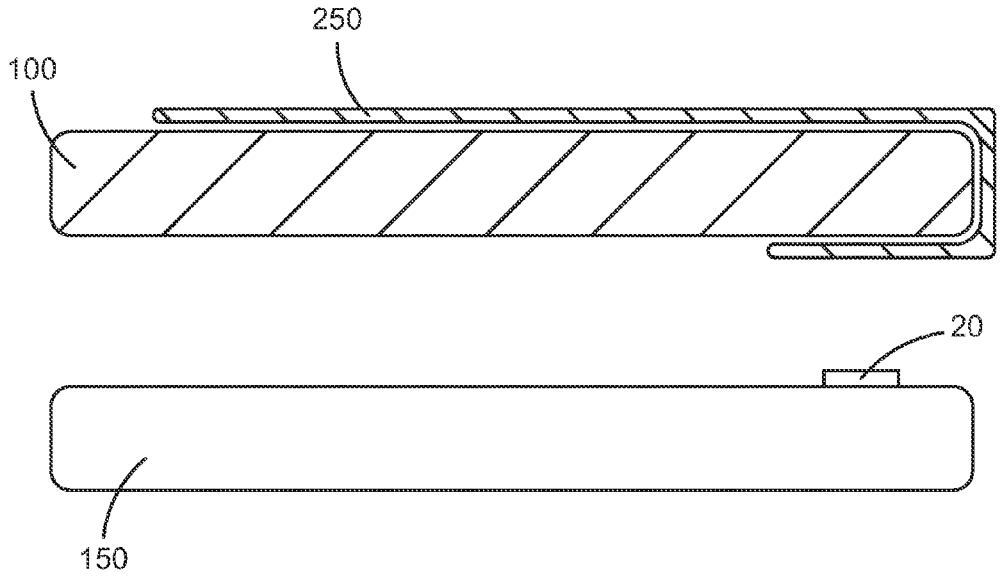
Figure 7:
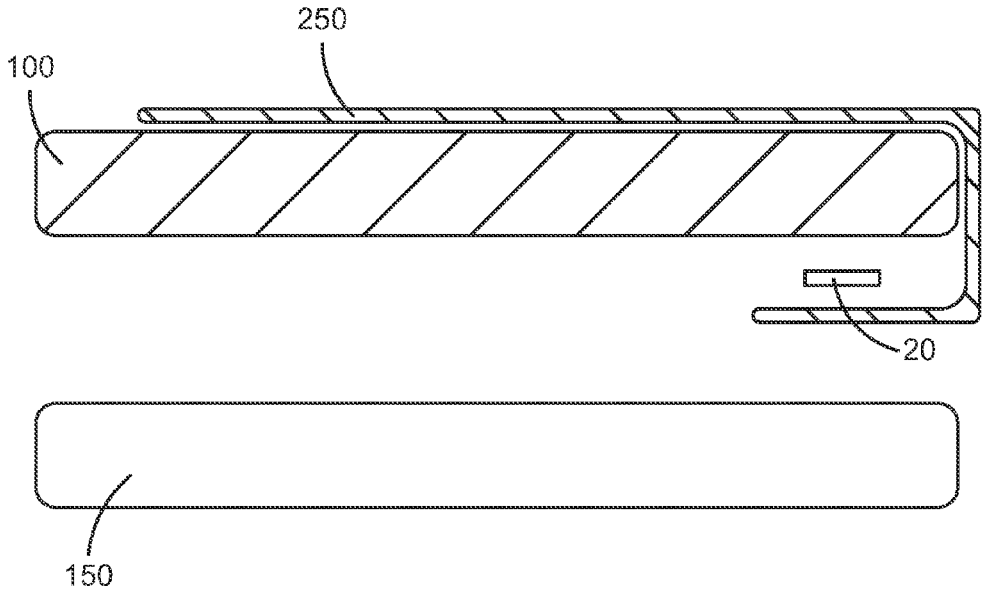
FIG. 7 is a side partial cross-sectional view of a sheet grip installed between a mattress and a flat sheet.

Referring now to FIG. 2, a preferred embodiment of a sheet grip 20 is shown. The sheet grip 20 is preferably used with a flat sheet and placed between a mattress and a box spring. The sheet grip 20 preferably has a rectangular or hour-glass shape and is made of machine-washable foam. Preferably, a sheet grip 20 is made from compressible low-density open cell polyurethane foam. However, other soft foams or materials can be used. To reduce weight and increase its gripping surface, the grip 20 can also have rounded slots 22 and rounded edges 23. As shown in FIGS. 5 and 6, the flat sheet grip 20 is preferably placed between the mattress 100 and box spring 150 under the flat sheet 250. The surfaces of the sheet grip 20 preferably have a high coefficient of friction, e.g. are rougher, than the mattress 100, box spring 150 and flat sheet 250. When the sheet grip 20 is inserted between the mattress 100 and box spring 150 and in contact with the flat sheet 250, the grip 20 resists removal or excessive movement of the flat sheet 250. Alternatively, the flat sheet grip 20 may be placed between the mattress 100 and flat sheet 250 as shown in FIG. 7.

Figure 3:
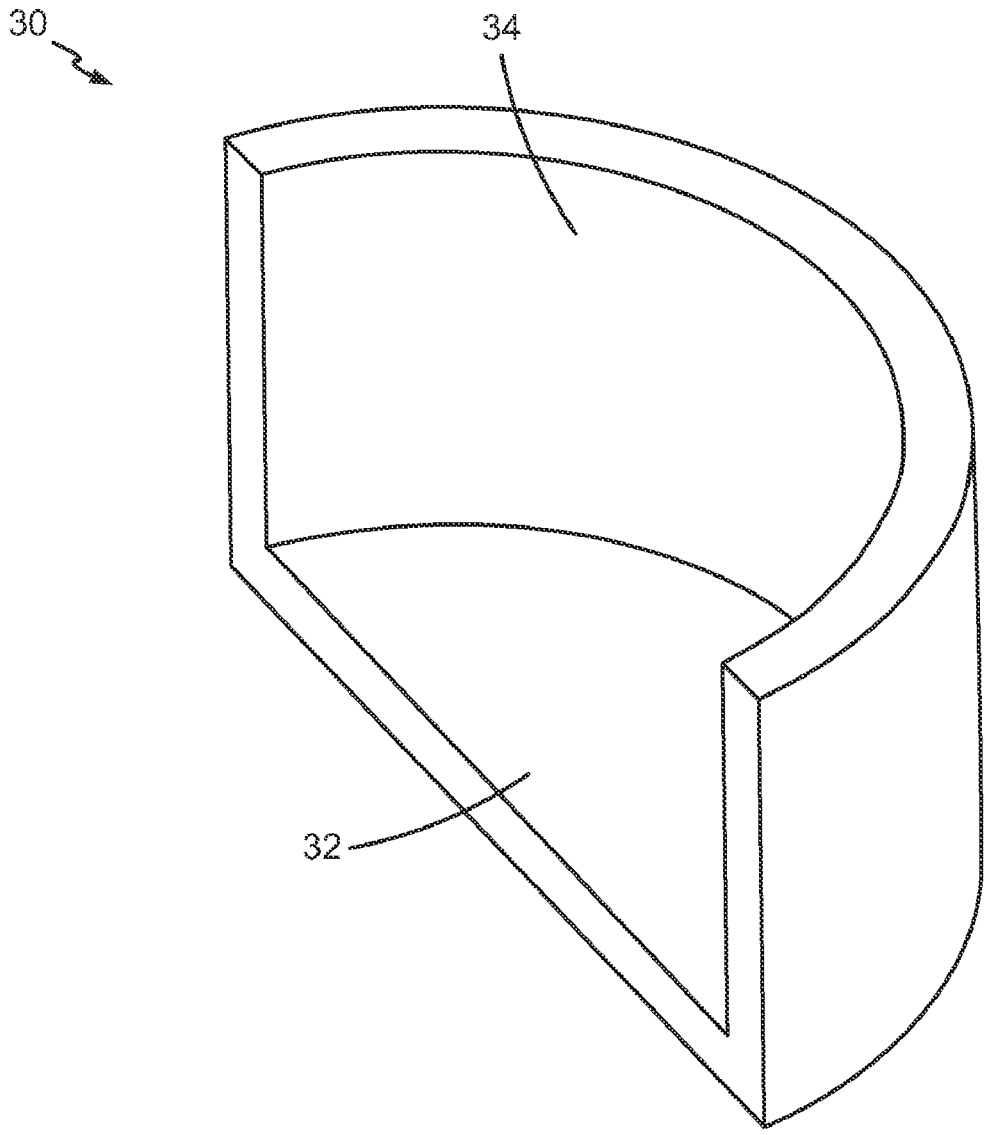
FIG. 3 is a perspective view of a preferred embodiment of a corner grip.

Referring now to FIG. 3, a preferred embodiment of a corner grip 30 is shown. The corner grip 30 preferably has a semi-circular base 32 and a rounded corner wall 34. Again, the corner grips 30 are preferably made of machine-washable foam similar or identical to the sheet grips 20. As shown in FIG. 4, the base 32 of each corner grip 30 is inserted between the mattress 100 and box spring 150 at the corners of the mattress 100 and box spring 150. The rounded corner walls 34 and the bases 32 provided friction for the fitted sheet 200 to be coupled to the mattress 100. Like the sheet grips 20, the surfaces of the corner grips 30 preferably have a high coefficient of friction, e.g. are rougher, than the mattress 100, box spring 150 and fitted sheet 200.

Various modifications and alterations of the invention will become apparent to those skilled in the art without departing from the spirit and scope of the invention, which is defined by the accompanying claims. It should be noted that steps recited in any method claims below do not necessarily need to be performed in the order that they are recited. Those of ordinary skill in the art will recognize variations in performing the steps from the order in which they are recited. In addition, the lack of mention or discussion of a feature, step, or component provides the basis for claims where the absent feature or component is excluded by way of a proviso or similar claim language.

While various embodiments of the present invention have been described above, it should be understood that they have been presented by way of example only, and not of limitation. Likewise, the various diagrams may depict an example architectural or other configuration for the invention, which is done to aid in understanding the features and functionality that may be included in the invention. The invention is not restricted to the illustrated example architectures or configurations, but the desired features may be implemented using a variety of alternative architectures and configurations. Indeed, it will be apparent to one of skill in the art how alternative functional, logical or physical partitioning and configurations may be implemented to implement the desired features of the present invention. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, may be combined in a single package or separately maintained and may further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives may be implemented without confinement to the illustrated examples. For example, block diagrams and their accompanying description should not be construed as mandating a particular architecture or configuration.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A bed sheet comprising:

a sheet restrictor having a slot and a base, wherein the base is configured to rotate, wherein the base is circular; and a sheet with four corners, where the sheet is inserted into the slot of the sheet restrictor, where the sheet restrictor further comprises a cylinder;

wherein the cylinder is configured to wrap the sheet around the cylinder, wherein the cylinder is configured to laterally tighten the sheet, wherein the cylinder is aligned with an edge of the base, wherein the cylinder is capable of wrapping around the sheet on a side of a bed and tightening the sheet with power and without ripping;

wherein the slot is formed from an opening in the cylinder, wherein the slot protrudes through a top of the opening in the cylinder, wherein the slot is aligned approximately tangential to the edge of the base, wherein the opening in the cylinder begins at or above the base, wherein the slot is vertical and configured to receive the sheet vertically into the slot; and four corner grips, where one corner grip is placed at each sheet corner.

2. The bed sheet of claim 1 further comprising a sheet grip.

3. A bed sheet comprising:

a sheet restrictor having a slot and a base, wherein the base is configured to rotate, wherein the base is circular; and a sheet with four corners, where the sheet is inserted into the slot of the sheet restrictor, where the sheet restrictor further comprises a cylinder;

wherein the cylinder is configured to wrap the sheet around the cylinder, wherein the cylinder is configured to laterally tighten the sheet, wherein the cylinder is aligned with an edge of the base, wherein the cylinder is capable of wrapping around the sheet on a side of a bed and tightening the sheet with power and without ripping; and wherein the slot is formed from an opening in the cylinder, wherein the slot protrudes through a top of the opening in the cylinder, wherein the slot is aligned approximately tangential to the edge of the base, wherein the opening in the cylinder begins at or above the base, wherein the slot is vertical and configured to receive the sheet vertically into the slot.

* * * * *